US005282779A

United States Patent [19]

Sakai et al.

[11] Patent Number: 5,282,779

[45] Date of Patent: Feb. 1, 1994

[54] AIR JET FOR PRODUCING FILTER PLUG FOR CIGARETTE

[75] Inventors: Takashi Sakai, Tokyo; Takashi Gando; Hiroshi Kitayama, both of Toyama, all of Japan

[73] Assignee: Mitsubishi Rayon Company Ltd., Tokyo, Japan

[21] Appl. No.: 987,192

[22] Filed: Dec. 8, 1992

[30] Foreign Application Priority Data

Dec. 9, 1991 [JP] Japan ..... 3-324390

[51] Int. Cl.[5] ..... A24D 3/02

[52] U.S. Cl. ..... 493/44; 493/50; 28/276; 28/283

[58] Field of Search ..... 493/39, 42, 44, 46, 493/48, 49, 50; 28/273, 274, 276, 283

[56] References Cited

U.S. PATENT DOCUMENTS

| | | | |
|---|---|---|---|
| 4,024,001 | 5/1977 | Lyon et al. | 493/44 |
| 4,316,475 | 2/1982 | Suzuki et al. | 131/340 |
| 4,411,641 | 10/1983 | Suzuki et al. | 493/46 |
| 4,468,845 | 9/1984 | Harris | 28/283 |
| 4,594,162 | 6/1986 | Berger | 210/493.1 |
| 4,661,090 | 4/1987 | Arthur | 493/44 |
| 4,747,814 | 5/1988 | Berger | 493/44 |
| 5,163,452 | 11/1992 | Marritt et al. | 131/84.1 |

FOREIGN PATENT DOCUMENTS

| | | | |
|---|---|---|---|
| 60-796 | 1/1985 | Japan . | |
| 2-29296 | 2/1990 | Japan . | |
| 1231291 | 5/1971 | United Kingdom | 493/44 |

*Primary Examiner*—William E. Terrell

*Attorney, Agent, or Firm*—Oblon, Spivak, McClelland, Maier & Neustadt

[57] ABSTRACT

An air jet for producing a filter plug for cigarette comprising an imparting portion for propelling force to a tow-like fiber bundle and a beak portion, wherein said imparting portion is constructed by a trumpet (21) having a converged tip end region, a trumpet holder (23) coaxially and encirclingly assembled on the trumpet (21) so that a primary air chamber (26*a*) is formed between the bodies of the trumpet and the trumpet holder, and an annular slit (29) communicated with the primary air chamber (26*a*) is also formed between the tip end regions of the trumpet (21) and the trumpet holder (23). An inner tube (22) is disposed coaxially in front of the assembly of the trumpet (21) and the trumpet holder (23), whereby a fiber path through which the tow-like fiber bundle is fed to a tongue of a filter plug machine is formed through the air jet along the axis thereof; the fiber bundle being accelerated by a propelling force imparted by compressed air ejected from the annular slit (29) to the fiber path. An inner tube holder (25) is coaxially and encirclingly assembled on the inner tube (22) to form the beak portion (30) so that a secondary air chamber (26*b*) is formed between the bodies of the inner tube (22) and the inner tube holder (25), and a means for opening and interlacing fibers in the fiber bundle is provided in the inner tube (22).

6 Claims, 3 Drawing Sheets

AIR JET FOR PRODUCING FILTER PLUG FOR CIGARETTE

BACKGROUND OF THE INVENTION

1. Field of the Invention

The present invention relates to an air jet for producing a filter plug for a cigarette; the filter plug of which has suitable filtration properties for removing tar and/or nicotine from a tobacco smoke stream with a lesser amount of tow-like fiber bundle filled in one filter plug. The filter plug formed by the air jet according to the present invention also has a high initial hardness as well as a high equilibrium hardness. Further the air jet according to the present invention has the ability to effectively form a filter plug from various fiber bundles having different total denier.

2. Description of Prior Arts

Indispensable characteristics for an air jet used in a filter plug machine when a filter plug is formed from a tow-like fiber bundle are as follows:

(1) The air jet must impart a sufficient propelling force to any tow-like fiber bundle having various total denier in a range of several thousand deniers through several tens of thousand deniers so that the fiber bundle can be smoothly and effectively delivered to a tongue of a filter plug machine and converted to a filter plug.

(2) The air jet must form a filter plug having a suitable filtration ability for removing tar and/or nicotine from a tobacco smoke stream with a lesser amount of tow-like fiber bundle filled in the filter plug.

(3) The air jet must form a filter plug having a high initial hardness as well as a high equilibrium hardness for enhancing ease of handling and preventing deformation thereof during smoking.

Conventionally, a tow-like fiber bundle containing an increased amount of plasticizer (generally triacetin) is used for obtaining a filter plug having a high equilibrium hardness so that the bonding points between fibers constituting the filter plug increase. In fact, the resultant filter plug has a high equilibrium hardness, but has the drawback that it softens because of the moisture contained in a smoke stream when smoked in combination with tobacco cylinder.

Another way to obtain a filter plug having a high initial hardness as well as a high equilibrium hardness is to increase the quantity of tow-like fiber bundle in one filter plug. The filter plug thus obtained, however, has drawbacks in that many punctures occur in the resultant filter plugs directly after formation thereof and the air suction resistance of the filter plug is so high that its aptitude as a cigarette filter is lowered.

In addition, it is necessary to form a filter plug with a tow-like fiber bundle of increased quantity such that the fiber bundle must be fed to a tongue of a filter plug machine with a higher propelling force. However, an air jet that can impart such a high propelling force to the fiber bundle has not yet been developed.

While, attempts to obtain an air jet satisfying the above indispensable characteristics (1) through (3) have been made. For example, Japanese Examined Utility Model Publication No. 60-796 discloses an air jet having a cross-section shown in FIG. 1. The air jet of this type is characterized by the provision of slits at a beak-like exit end so that a higher pressure air stream can be used relative to a conventional transport type air jet, whereby a tow-like fiber bundle can be fed to a tongue of a filter plug machine with a high propelling force.

However, if a filter plug having a high initial hardness is formed while using this air jet, the amount of tow-like fiber bundle filled in one filter plug is increased and air suction resistance thereof becomes higher.

In Japanese Unexamined Utility Model Publication No. 2-29296, an air jet is disclosed for feeding a tow-like fiber bundle containing a plasticizer and having active carbon particles adhered on one side thereof to a filter plug machine. The air jet is adapted to minimize the drop-off of the active carbon particles from the fiber bundle by an air stream during movement of the fiber bundle to the filter plug machine. As shown in FIG. 2, this air jet comprises an inner tube 2 having a fiber path 3 therein and an outer tube 1 encircling the inner tube 2. An air circulation chamber 4 is provided between both tubes 1, 2. A plurality of air guiding walls 5*a*, 5*b*, 5*c* and 5*d* are formed lengthwise on an outer surface of the inner tube 2, while encircling the same. A plurality of air nozzles 6*a*, 6*b*, 6*c* and 6*d* are provided at the respective base portions of the air guiding walls, while slanting in the travelling direction of the fiber bundle and communicating from the interior of the air circulation chamber of the inner tube to the fiber path. Air inlet ports 8, 9 are provided on the outer tube 1 at the upstream end and the downstream end thereof, respectively. An air suction slit 11 is formed between an air deviation guide 10 provided in the downstream area of the fiber path of the inner tube and the downstream end air guiding wall 6*b* so that air ejected into the fiber path is circulated into the air circulation chamber and the active carbon particles dropping off from the tow-like fiber bundle during transportation by the air jet are again fed to the fiber bundle by high pressure air. This air jet in fact can feed the fiber bundle to a garniture portion of a filter plug machine while preventing the active carbon particles from dropping off from the fiber bundle, but has the drawback that a satisfying filter plug having a high initial hardness is not usually obtained.

SUMMARY OF THE INVENTION

An object of the present invention is to solve the above drawbacks of the prior art and to provide an air jet for satisfying the above-mentioned indispensable characteristics (1) through (3) and having an ability to form a filter plug excellent in initial hardness as well as equilibrium hardness even though a tow-like fiber bundle containing less plasticizer is used.

The gist of the present invention resides in an air jet for producing a filter plug for cigarette comprising an imparting portion for propelling force to a tow-like fiber bundle and a beak portion, wherein said imparting portion is constructed by a trumpet having a converged tip end region, a trumpet holder coaxially and encirclingly assembled on the trumpet so that a primary air chamber is formed between the bodies of the trumpet and the trumpet holder, and an annular slit communicated with the primary air chamber is formed between the tip end regions of the trumpet and the trumpet holder, and said beak portion is constructed by an inner tube and an inner tube holder, said inner tube being disposed coaxially in front of the assembly of the trumpet and the trumpet holder, whereby a fiber path through which the tow-like fiber bundle is fed to a tongue of a filter plug machine is formed through the air jet along the axis thereof and said inner tube holder being coaxially and encirclingly assembled on the inner tube to form said beak portion so that a secondary air chamber is formed between the bodies of the inner tube and the inner tube holder, and means for opening and interlacing fibers in the fiber bundle being provided in the inner tube.

Preferably the means for opening and interlacing fibers in the fiber bundle is a plurality of through-holes provided on the periphery of the inner tube while arranged on a cross-sectional circle thereof to communicate the secondary chamber with the fiber path in the beak portion so that fibers in the fiber bundle are opened and interlaced with each other by compressed air ejected from the secondary air chamber through the through-holes. Favorably a diameter of the through-hole is within a range of 0.5 mm through 2 mm, and the number of through-holes is in the range of 2 through 20.

An angle of the through-hole relative to the running direction of the fiber bundle is preferably in a range of 10° through 120°.

A plurality of slits are preferably provided in the beak portion within a region of 20 mm from the tip end thereof.

BRIEF DESCRIPTION OF THE DRAWINGS

The other objects and advantages of the present invention will be more apparent with reference to the attached drawings illustrating the preferred embodiments; wherein.

DETAILED DESCRIPTION OF THE PREFERRED EMBODIMENTS

Figure 3:
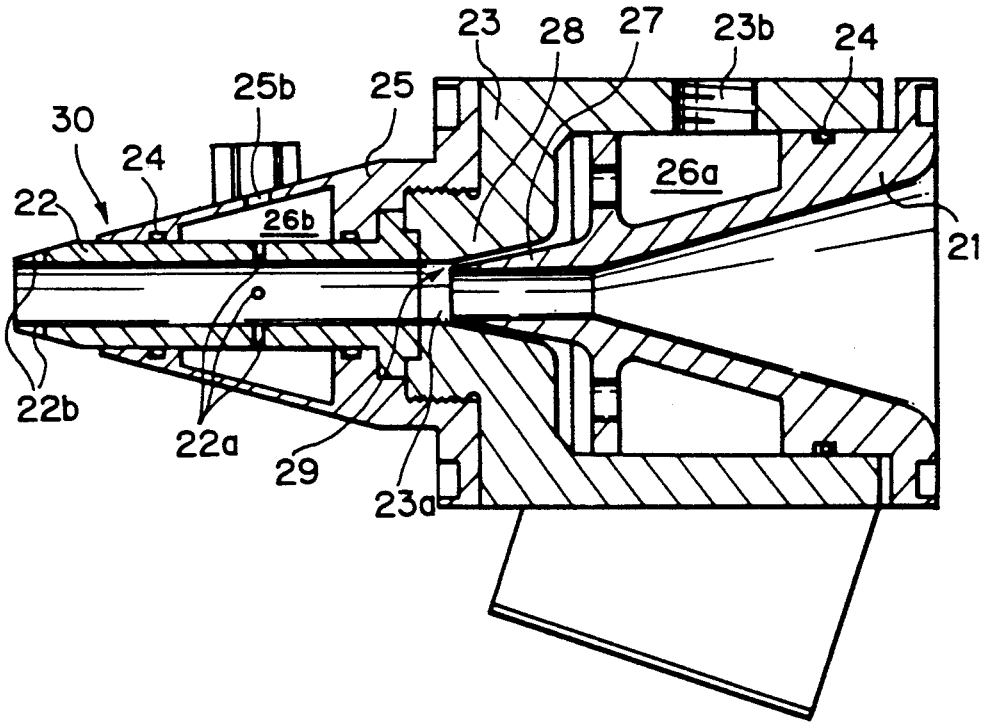
FIG. 3 is a side sectional view of a typical air jet according to the present invention.
Figure 2:
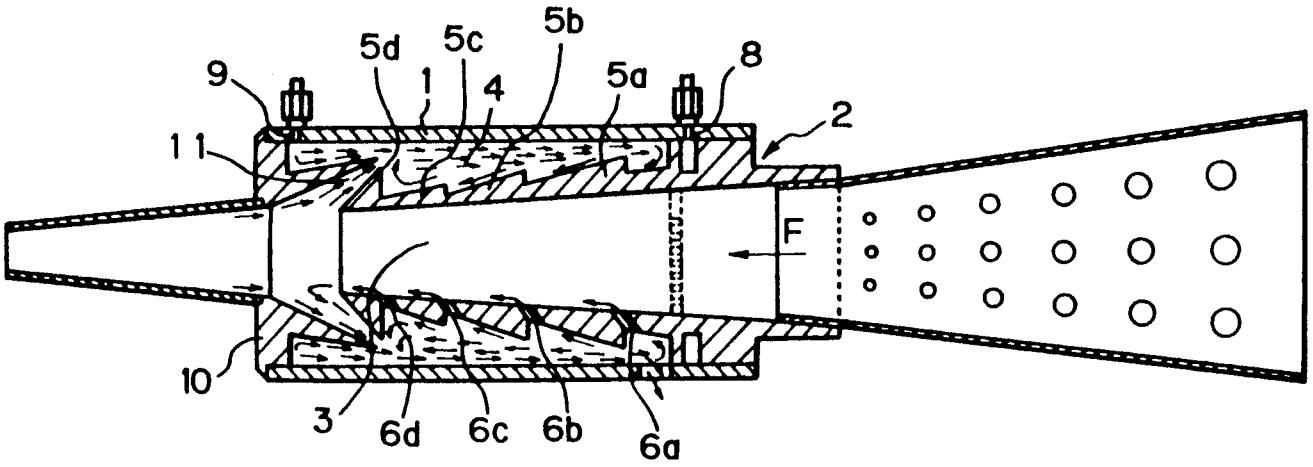
Fig. 2 (PRIOR ART)
FIG. 2 is a side sectional view of another prior art air jet.

In FIG. 3, a trumpet holder 23 is insertingly fixed via an O ring 24 on a trumpet 21 for feeding a tow-like fiber bundle into a filter plug machine. A primary air chamber 26*a* is formed between the trumpet holder 23 and the trumpet 21, and communicated with a compressed air inlet port 23*b*. An annular slit 29 is formed between a tip end portion 28 of the trumpet holder 23 and a tip end portion 27 of the trumpet 21 for ejecting compressed air and sucking a tow-like fiber bundle thereby through an exit 23*a* at a high rate toward the tongue of filter plug machine.

Figure 4:
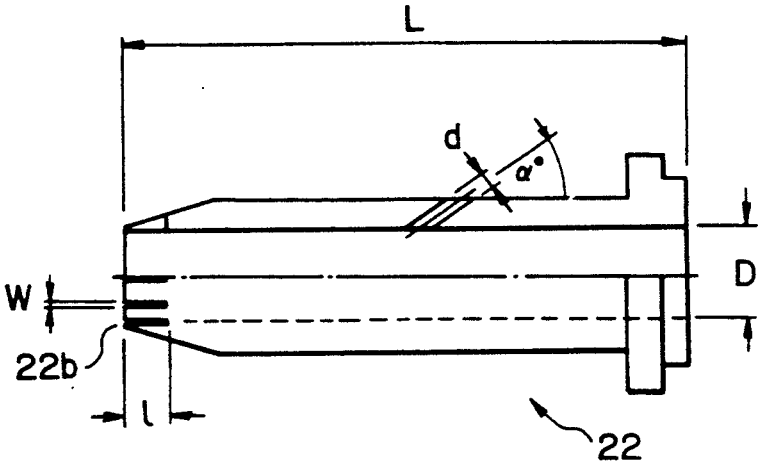
FIG. 4 is a side sectional view of an inner tube that is a part of the air jet according to the present invention.

The most characteristic feature of the air jet according to the present invention resides in that a beak portion 30 provided with means for opening and interlacing fibers in the fiber bundle is fixed in front of the exit 23*a* of the trumpet 21. In FIG. 3, the means for opening and interlacing fibers in the fiber bundle are through-holes 22*a* for ejecting compressed air stream onto the outer surface of the fiber bundle, arranged on the periphery of an inner tube 22 constructing the beak portion 30. As shown in FIG. 4, the through-holes 22*a* are preferably circularly arranged on the periphery of the inner tube 22 and having an angle $\alpha$ in a range of 10° through 120° relative to the travelling direction of the fiber bundle. A diameter d of the through-hole is preferably in a range of 0.5 mm through 2 mm, more preferably in a range of 0.6 mm through 1.6 mm. The number of through-holes is favorably in a range of 2 through 20, more favorably 2 through 16 for carrying out a uniform opening/interlacing treatment on the fiber bundle running through the inner tube. The through-holes are preferably arranged in a one or two circular rows.

When the angle $\alpha$ of the through-hole is less than 10° relative to the travelling direction of the fiber bundle, it is difficult to sufficiently open and interlace fibers in the fiber bundle running through the inner tube even though a feed rate and/or a pressure of compressed air passing the through-holes is properly regulated, whereby a filter plug having a desired initial hardness and a desired equilibrium hardness is hardly obtained. While, when the angle $\alpha$ exceeds 120°, the high speed running of the fiber bundle through the inner tube is liable to be interrupted. Accordingly, a compromising range of the angle $\alpha$ of the through-hole on the inner tube of the beak portion is preferably 10° through 120°, more preferably 20° through 100°, in which the high speed travelling of the fiber bundle through the inner tube is not interrupted and the satisfying opening and interlacing effects are imparted to the fiber bundle so that the desired initial/equilibrium hardness is obtained in the resultant filter plug.

If the diameter of the through-hole is less than 0.5 mm or exceeds 2 mm, an air stream ejected therefrom is liable to be insufficient or uneven whereby the opening/interlacing effects become unsatisfactory or unhomogeneous. Therefore, the resultant filter plug has a lower or uneven initial hardness.

By an air jet with an inner tube having a single through-hole on the periphery of the tube wall or with an inner tube having a row of through-holes arranged in a lengthwise direction of the inner tube, it is difficult to form a filter plug having a proper initial hardness because a uniform opening/interlacing treatment is not sufficiently imparted to a tow-like fiber bundle. Further, the wide range regulation of a propelling force applied to the fiber bundle running through the beak portion is difficult according to the aforementioned air jet.

In contrast, in the case of an air jet according to the present invention, since the propelling force applied to the fiber bundle can be widely regulated, any fiber bundle selected from a group having various total denier can be suitably formed into a filter plug.

As the beak portion of the air jet according to the present invention is connected to a tongue of a filter plug machine in use, compressed air ejectingly leaks out from a gap between a tip end of the beak portion and the tongue during the operation thereof. This leakage of compressed air should be effectively managed, otherwise fibers in the fiber bundle may be disordered during passage through this area. To avoid such inconveniences, a plurality of slits 22*b* are formed in the tip end region of the beak portion within a range not exceeding 20 mm, as shown in FIG. 4. If the slit 22*b* exceeds 20 mm, the leakage of compressed air therethrough is too much to effectively feed the fiber bundle into the filter plug machine. The length of the slit is preferably less than 12 mm.

The beak portion 30 of the air jet according to the present invention is constructed by the inner tube 22 and the inner tube holder 25 that has a hollow truncated conical shape and is encirclingly and coaxially fixed on the outer periphery of the inner tube 22 via an O-ring 24. It is preferable to form a secondary air chamber 26*b* between the inner tube 22 and the inner tube holder 25, because uniform pressure air can be fed to the through-holes 22*a* for opening and interlacing the fiber bundle.

The secondary air chamber 26b is communicated with a compressed air inlet port 25b.

As shown in FIG. 3, the beak portion 30 and the trumpet 21 are fixed to each other by the thread engagement of the tip end region of the trumpet holder 23 with the rear end region of the inner tube holder 25 so that the exit 23a is formed therebetween. Alternatively, this fixation may be carried out by a bolt/nut connection or an adhesive.

The air jet according to the present invention is built-in in the filter plug machine, and the production of the filter plug from the tow-like fiber bundle is carried out as follows:

The fiber bundle is introduced into the air jet through the trumpet 21 and driven by a propelling force caused by the compressed air ejected from the annular slit 29 to be brought in contact with the fiber bundle. The fiber bundle runs through the exit 23a into the inner tube 22 constructing the beak portion 30, in which fibers in the fiber bundle are sufficiently opened and interlaced with each other by the action of ejected air from the through-holes 22a. Then the fiber bundle is continuously introduced into the tongue of the filter plug machine to be formed as a filter plug. The resultant filter plug has a high initial hardness.

Figure 1:
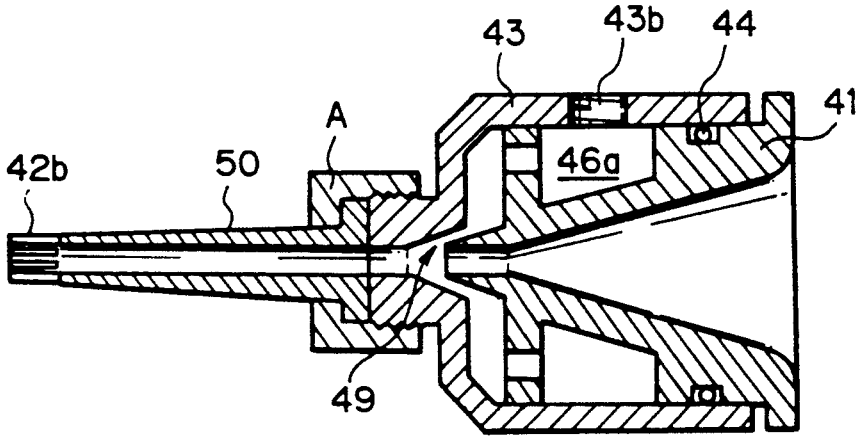
Fig. 1 (PRIOR ART)
FIG. 1 is a side sectional view of a prior art air jet.

Such effects cannot be achieved by a prior art air jet disclosed, for example, in Japanese Examined Utility Model Publication No. 60-796 and illustrated in FIG. 1, in which reference numeral 41 refers to a trumpet, 43 to a trumpet holder and 50 to a beak portion having slits 42b in the tip end region thereof. The trumpet 41 is fixed to the beak portion 50 by a connecting member A. Between the trumpet 41 and the trumpet holder 43 is formed a primary air chamber 46a, one end of which is communicated with a compressed air inlet port 43b and the other end is communicated with an annular slit 49 for imparting a propelling force to the fiber bundle. According to the air jet of this type, a fiber quantity filled in one filter plug can be increased to some extent so that the resultant filter plug has a high initial hardness when the air jet is built-in in a filter plug machine. However, this filter plug has excessive air suction resistance and therefore is not suitable for a cigarette filter.

According to the air jet of the present invention, means for supplying compressed air into a fiber path is divided into two parts; i.e., one being the annular slit formed between the tip end region of the trumpet and the trumpet holder and the other being the through-holes provided in the middle region of the beak portion. Thereby resulting in easier regulation of a propelling force imparted to the fiber bundle, whereby a filter plug suitable for a cigarette filter can be obtained even from a tow-like fiber bundle having a large total denier. In addition, the provision of a means for opening and interlacing fibers in the fiber bundle in the beak portion enables the production of a filter plug having a high initial hardness as well as a high equilibrium hardness even though it has less fiber quantity filled therein.

Examples of the present invention will be described below, wherein the estimations of characteristics are as follows:

1) Initial Hardness:

The hardness of a filter plug is measured within 20 min after the formation thereof using a FTS-400 tester manufactured by FILTRONA Instrument & Automation Ltd.

2) Equilibrium Hardness:

The hardness of a filter plug is measured after the same has been placed for a whole day and night in a room maintained at a temperature of 20° C. and a relative humidity of 65%, using a FTS-400 tester manufactured by FILTRONA Instrument & Automation Ltd.

Both initial hardness and equilibrium hardness is expressed in (%) which is measured by the following formula $$\frac{d}{D} \times 100\ (\%)$$

in which D represents the outer diameter of a filter plug before loading and d represents the outer diameter of it after loading.

3) Air Suction Resistance:

In accordance with CORESTA STANDARD METHOD No. 10 (1968 September), air suction resistance is measured using a FTS-400 tester manufactured by FILTRONA Instrument & Automation Ltd.

Namely, air suction is expressed in mm water column calculated by measuring the difference in pressure, as a pressure drop relative to air pressure, between air inlet and air exit of a filter plug when a stream of air flows through it at 17.5 ml/s, a temperature of 20° C. and a relative humidity of 60%.

4) Formation Range:

A formation range is defined as a value obtained by subtracting the minimum weight of a filter plug (lower limit weight) from a maximum weight thereof (upper limit weight) in a capability curve. A higher value indicates a higher ability of an air jet for feeding a tow-like fiber bundle into a tongue of a filter plug machine and vice versa.

EXAMPLES 1 THROUGH 5

A crimped tow of cellulose diacetate fibers having a total denier of 36,000 was used as a fiber bundle for the production of a filter plug, each fiber of which has a denier of 3 and a Y-shaped cross-section. Five air jets having a structure illustrated in FIG. 3 were prepared. Each of the air jets had through-holes arranged in one row in an inner tube for opening and interlacing fibers in the tow. The diameter of each through-hole was 1 mm. The length of each inner tube L was 76 mm and the inner diameter D was 12 mm. Eight slits were provided having a length 1 of 5 mm and a width W of 1 mm. The minimum inner diameter of a fiber path in the tip end region of a trumpet 21 was 10 mm. The angle $\alpha$ (defined before) and the number of through-holes in the respective air jets were different from each other as shown in Table 1.

The respective air jet was built-in in a filter plug machine (KDFII/AFII, Hauni-Werke Körber & Co. KG) and the formation of a filter plug was carried out so that a filter plug with a plasticizer content of 6 weight % having a cross-sectional circular length of 24.7 mm, a longitudinal length of 120 mm and a tow weight of 6.5 g/10 pieces was obtained, while keeping the pressure in a primary air chamber 26a at 1.5 kg/cm$^2$G, the pressure in a secondary air chamber 26b at 2.0 kg/cm$^2$G and formation speed of the filter plug at 400 m/min. Characteristics of the filter plugs thus obtained were measured, which are listed in Table 1.

As apparent from Table 1, all the filter plugs obtained by using the air jets according to the present invention had a higher initial hardness of more than 84%. This was also true for the equilibrium hardness. The air suction resistance was in a proper range of 336 through 339 even though the initial hardness is at a higher level. The formation range of the inventive air jet was very wide, i.e., from 1.62 to 2.15, which means that this air jet has the ability to form a filter plug from various fiber bundles having a wide range of total denier.

COMPARATIVE EXAMPLES 1 AND 2

Figure 5:
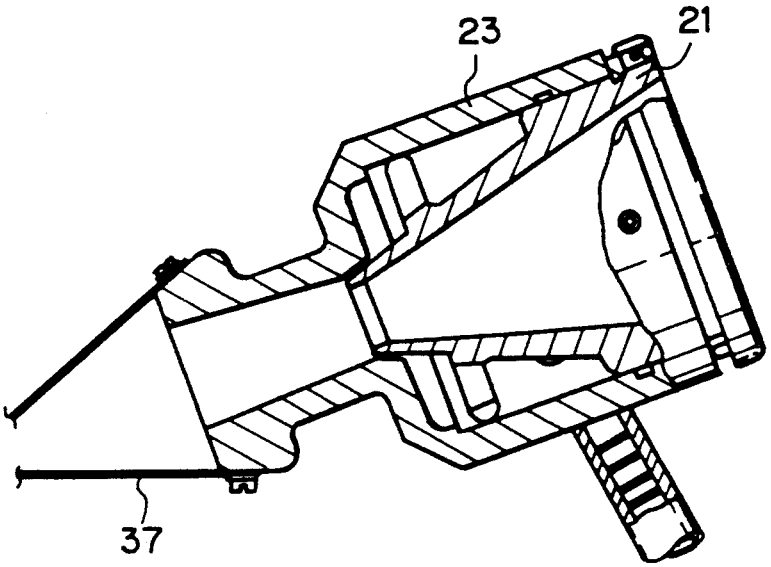
Fig. 5 (PRIOR ART)
FIG. 5 is a side sectional view of a prior art transport type air jet.

Two air jets having structures illustrated in FIGS. 1 and 5, respectively, were built-in in the filter plug machine and the formation of filter plug was carried out while using the same fiber tow used in Examples 1 through 5. Air pressure was 1.5 kg/cm$^2$G. The characteristics of the resultant filter plugs were evaluated in the same manner as before and listed in Table 1.

As stated above, according to an air jet of the present invention, since fibers in a tow-like fiber bundle can be sufficiently opened and interlaced with each other during travel thereof into a filter plug machine, a filter plug that is excellent in initial hardness as well as equilibrium hardness and has suitable air suction resistance can be obtained.

TABLE 1

| | Ex. 1 | Ex. 2 | Ex. 3 | Ex. 4 | Ex. 5 | Comparative Ex. 1 *1) | Comparative Ex. 2 *2) |
|---|---|---|---|---|---|---|---|
| Number of through-holes | 2 | 4 | 8 | 16 | 4 | — | — |
| Diameter of through-holes (mm) | 1.0 | 1.0 | 1.0 | 1.0 | 1.0 | — | — |
| Angle α (°) | 45 | 45 | 45 | 45 | 60 | — | — |
| Initial hardness (%) | 84.0 | 85.4 | 84.3 | 84.6 | 85.8 | 83.4 | 83.3 |
| Equilibrium hardness (%) | 91.3 | 91.4 | 91.2 | 91.4 | 92.2 | 91.0 | 90.9 |
| Air suction resistance (mm water column) | 337 | 338 | 336 | 339 | 339 | 329 | 328 |
| Formation range (g/10 pcs) (plasticized) | 1.68 | 1.65 | 2.15 | 1.62 | 1.66 | 1.50 | 1.45 |

Note:
*1) An air jet illustrated in FIG. 1 was used.
*2) A transport type air jet illustrated in FIG. 5 was used.

We claim:

1. An air jet for producing a filter plug for cigarette comprising an imparting portion for propelling force to a tow-like fiber bundle and a beak portion, wherein said imparting portion is constructed by a trumpet having a converged tip end region, a trumpet holder coaxially and encirclingly assembled on the trumpet so that a primary air chamber is formed between the bodies of the trumpet and the trumpet holder, and an annular slit communicated with the primary air chamber is formed between the tip end regions of the trumpet and the trumpet holder, and said beak portion is constructed by an inner tube and an inner tube holder, said inner tube being disposed coaxially in front of the assembly of the trumpet and the trumpet holder, whereby a fiber path through which the tow-like fiber bundle is fed to a tongue of a filter plug machine is formed through the air jet along the axis thereof said inner tube holder being coaxially and encirclingly assembled on the inner tube to form said beak portion so that a secondary air chamber is formed between the bodies of the inner tube and the inner tube holder, and means for opening and interlacing fibers in the fiber bundle being provided in the inner tube.

2. An air jet according to claim 1, wherein the means for opening and interlacing fibers in the fiber bundle is a plurality of through-holes provided on the periphery of the inner tube while arranged on a cross-sectional circle thereof to communicate the secondary chamber with the fiber path in the beak portion so that fibers in the fiber bundle are opened and interlaced with each other by compressed air ejected from the secondary air chamber through the through-holes.

3. An air jet according to claim 2, wherein the diameter of the through-hole is within a range of 0.5 mm through 2 mm.

4. An air jet according to claim 2, wherein the number of through-holes is in a range of 2 through 20.

5. An air jet according to claim 2, wherein an angle of the through-hole relative to the running direction of the fiber bundle is in a range of 10° through 120°.

6. An air jet according to any one of the claims 1 through 5, wherein a plurality of slits are provided in the beak portion within a region of 20 mm from the tip end thereof.

* * * * *